United States Patent [19]

Rise

[11] Patent Number: 5,031,254

[45] Date of Patent: Jul. 16, 1991

[54] WATER CONSERVING TOILET FLUSH CONTROL

[76] Inventor: Leif Rise, 7748 Westlawn Ave., Los Angeles, Calif. 90045

[21] Appl. No.: 493,620

[22] Filed: Mar. 15, 1990

[51] Int. Cl.[5] ..... E03D 1/14

[52] U.S. Cl. ..... 4/324; 4/415

[58] Field of Search ..... 4/415, 324, 325

[56] References Cited

U.S. PATENT DOCUMENTS

| | | | |
|---|---|---|---|
| 3,036,313 | 5/1962 | Jenkins | 4/324 |
| 3,538,519 | 11/1970 | Weisz | 4/325 |
| 3,908,203 | 9/1975 | Jackson | 4/7 A |
| 3,996,629 | 12/1976 | Riedel | 4/324 |
| 4,114,204 | 9/1978 | Black | 4/324 |
| 4,117,556 | 10/1978 | Semler | 4/325 |
| 4,143,430 | 3/1979 | Joshi et al. | 4/415 X |
| 4,328,596 | 5/1982 | Renz | 4/327 X |
| 4,364,129 | 12/1982 | Schonger | 4/324 |
| 4,365,364 | 12/1982 | Riedel | 4/378 |

*Primary Examiner*—Charles E. Phillips

*Attorney, Agent, or Firm*—William H. Maxwell

[57] ABSTRACT

A manual flush control for toilets having a normally closed float valve held shut by the head of water pressure in the flush tank, and characterized by a height limiting means for said valve to cause servo closing and preempting automatic operation.

5 Claims, 2 Drawing Sheets

WATER CONSERVING TOILET FLUSH CONTROL

BACKGROUND OF THE INVENTION

This invention relates to toilet flush systems that are in wide use and characterized by a floating valve, either a ball valve or a flapper valve. This is the flush valve that holds a substantial volume of water in the flush tank, for sudden release to cause flushing of the toilet bowl, followed by refilling responsive to a float controlled filling means. This flush valve is essentially a releasable check valve held shut by the head of water pressure as the flush tank is filled, a feature of this valve being the entrapment of air within a downwardly open chamber, so that it will float upward when liftted from the valve seat, and so that it will float downward to re-seat when the water level drops to seat level. There is presently no control over these flush valves when they have been released by initial lifting from the valve seats, so that each operation of the usual flush system consumes an entire flush tank of water. Consequently, toilets of this type are designed to minimize water volume requirements, either by reducing the flush tank volume or by reducing the flush water velocity. And, as a result the flushing performance is often inadequate, so that a second flushing is often required; with the obvious over use of water. However, in the event of an insufficient flushing, a small additional surge of water will complete the operation; but this is not possible with the state of the art flush systems of the type under consideration. Therefore, it is an object of this invention to provide a control by which the discharge of flush water is manually controlled as circumstances require, whereby the flush valve can be shut the moment sufficient flushing has been attained.

It is an object to retrofit toilet flush ball valves and toilet flush flapper valves with a height limiting means, all without change thereto, whereby the toilet flush system is converted to manual control. The prior art principle of operation requires lifting the valve from the seat to a level where flotation overcomes the downward pull of the released flushing water, it being an object of this invention to provide limiting means that precludes reaching this flotation level by holding a restricted position below it. Consequently, the downward pull of released flushing water inherently drags the valve onto the seat to shut off flushing water flow as may be required. Therefore, only enough water need be used through observation by the user when flushing the toilet. For example, a small deposite of urine or fecal matter will require but a short burst of flushing water, and likwise an insufficient previous flushing will be completed with a short burst.

Ball type flush valves are comprised of a large diameter body establishing a float chamber, downwardly open, positioned by a vertically reciprocable lift rod operating through a guide supported by an overflow tube that opens from the top of the flush tank and into the flush passage beneath the flush valve seat. The limiting means is provided herein to restrict lifting of said rod and ball valve positioned by the rod. It is an object of this invention to provide limiting means in the form of a clamp positioned on the rod to restrict lifting of the ball flush valve. In practice, there is a determinable height limit to which the ball type flush valve can be restricted, and it is another object of this invention to incorporate a position determining gage into the height limiting means clamp, an expendable breakaway feature.

Flapper type flush valves are comprised of a large diameter body establishing a float chamber, downwardly open, positioned by a lever swinging from pivots supported by an overflow tube that opens from the top of the flush tank and into the flush passage beneath the flush valve seat. The limiting means is provided herein to restrict lifting of the flapper valve by a chain, and is in the form of a bracket positioned on the overflow tube by a clamp member at a height determined by a gage.

Tilt flapper type flush valves are comprised of a large diameter body establishing a float chamber, downwardly open, carried and positioned by a stop lever swinging from pivots supported at one side of the flush valve seat that opens into the flush passage. There is a flush timer means in the form of a metering cup that empties so as to delay closing of the flapper. And the limiting means is provided to restrict tilting of the flapper by a lifting chain, and in the form of an intervening spacer adapted to the existent stop lever thereof. Limited opening of the flapper is predetermined by the spacer dimensions.

Tilt disc type flush valves are comprised of a large diameter disc with an overlying body establishing a closed float chamber, carried and positioned by a stop lever swinging from pivots supported at one side of the flush valve seat that opens into the flush passage. There is a flush timer means in the form of a metering cup that empties so as to delay closing of the disc. And, the limiting means is provided to restrict tilting of the disc by a lifting chain, and in the form of an intervening spacer adapted to the existent stop lever support thereof. Limited opening of the disc is predetermined by the spacer dimensions.

SUMMARY OF THE INVENTION

This invention is charcterized by height limiting means that restricts lifting of a flush valve from a flush valve seat in a toilet having a flush tank that is automatically filled with water to a controlled level. It is a flush valve having a float chamber with which this invention is concerned, it being a general object to prevent automatic full flushing each and every time the toilet is flushed. On the contrary, it is the purpose of this invention to enable descrete manipulation of a completely controlled flushing system whereby adequate flushing is attainable on every occasion, with the use of only that amount of water which is necessary for adequate flushing. As will be described, the limiting means herein disclosed is applicable to retrofit existing toilets without any alterations, simply by affixing a height limiting means to the overflow tube or like part of the toilet. Extreme simplicity and practicality is the essence of this invention.

The foregoing and various other objects and features of this invention will be apparent and fully understood from the following detailed description of the typical prefered forms and applications thereof, throughout which description reference is made to the accompanying drawings.

THE DRAWINGS

PREFERRED EMBODIMENT

Figure 1:
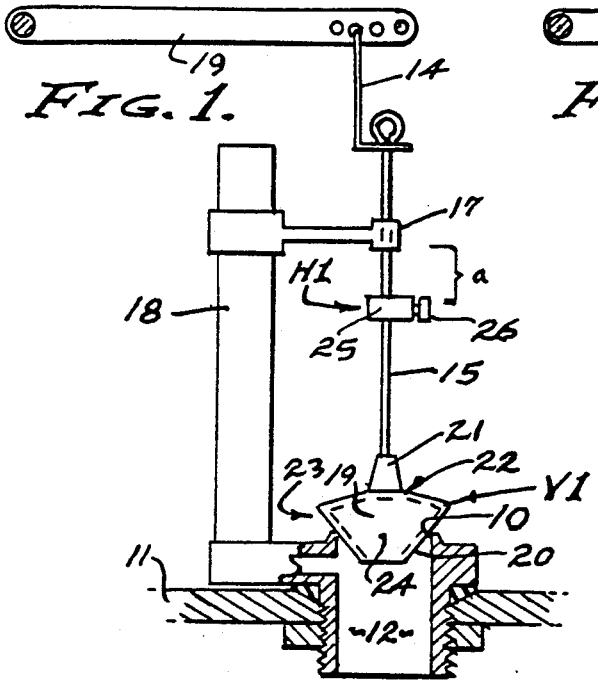
FIG. 1 is a view of a ball type float valve mechanism, with the limiting means of the present invention adapted thereto.
Figure 5:
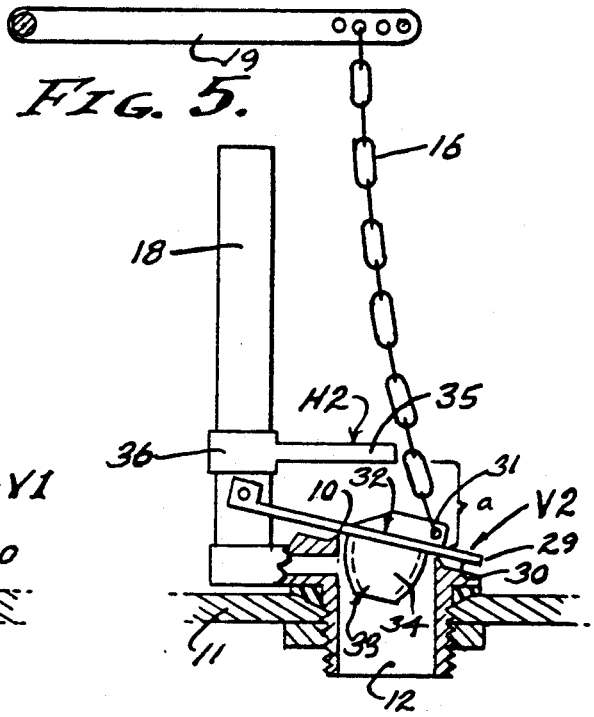
FIG. 5 is a view of a flapper type float valve mechanism, with the limiting means of the present invention adapted thereto.
Figure 2:
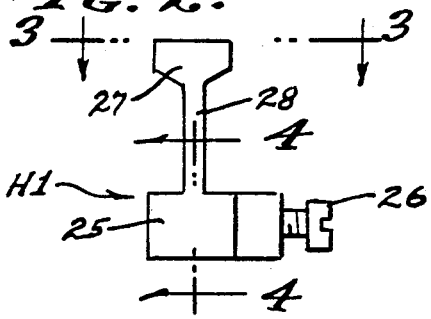
FIG. 2 is an enlarged view of the limiting means removed and with the positioning gage incorporated therein.
Figure 6:
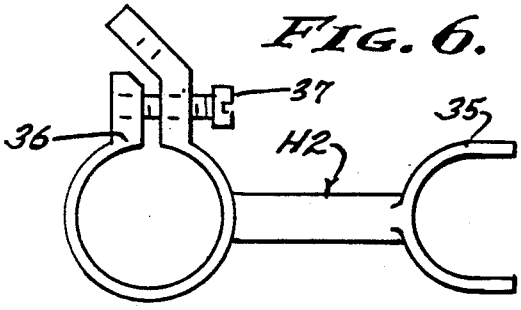
FIG. 6 is an enlarged view of the limiting means removed.
Figure 8:
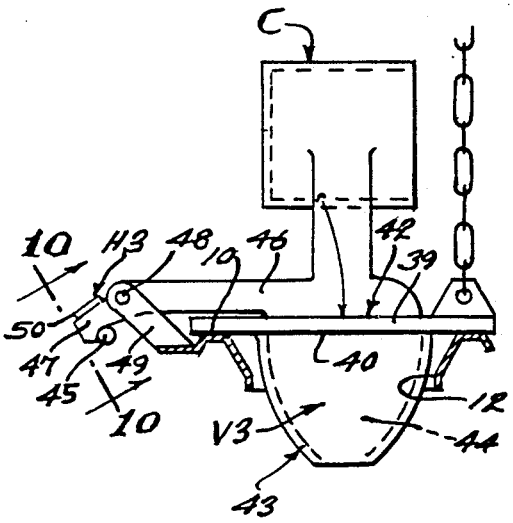
FIG. 8 is a view of a tilt flapper float valve mechanism in a closed condition, with the limiting means of the present invention adapted thereto.
Figure 11:
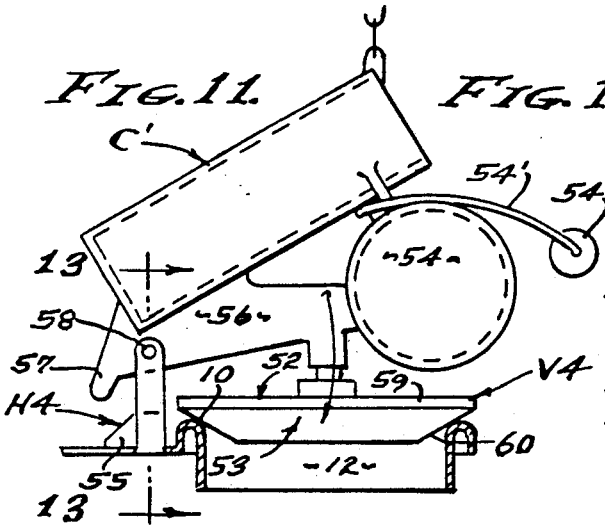
FIG. 11 is a view of a tilt disc float valve mechanism in a closed condition, with the limiting means of the present invention adapted thereto.

Referring to the drawings, there are a number of widely used flush valves for toilets, and among which there is the ball type float valve V1 shown in FIG. 1 of the drawings, the flapper type float valve V2 shown in FIG. 5 of the drawings, the tilt flapper type float valve V3 shown in FIG. 8 of the drawings, and the tilt disc type float valve shown in FIG. 11 of the drawings. That is, these are check valves that close a large diameter valve seat 10 opening from a flush tank 11 to permit the flow of flush water through a flush passage 12 when the valve is lifted. State of the art flush valves are characterized by an integral float chamber by which they are buoyant in order to remain elevated once lifted off the seat 10, until the water level subsides in the flush tank 11. This is an automatic function inherent in the operation of state of the art toilets, by means of a link 14 that slides on a lift rod 15 to initially lift a a ball type float valve V1 (see FIG. 1), or by means of a loose linked chain 16 to initially lift flapper type float valve V2 (see FIG. 5) or tilt flapper type float valve V3 (see FIG. 8), or to lift a tilt disc type float valve V4 (see FIG. 11). The lift rod 15 slides through a guide bracket 17 supported by an overflow tube 18, while the chain 16 requires no guide, both being lifted by a manually operated lever 19. The toilet mechanism thus far described is standard.

The ball type float valve V1 is shown in FIG. 1, comprised of a large diameter body 19 of rubber or the like, having a downwardly and inwardly tapered or convexly shaped sealing face 20 to engage on the upwardly faced valve seat 10. Seat 10 is a circular lip engageable with the face 20. The lift rod 15 is a straight vertically disposed rod secured into the center of the valve body 19, as by means of a threaded connector 21 imbedded in a top wall 22 of the body 19, there being a depending peripheral wall 23 that estalishes the sealing face 20. A characteristic feature of the valve V1 is that it is buoyant, and to this end the body 19 is formed by the walls 22 and 23 to establish a float chamber 24 by which the valve body 19 will float. In practice, the chamber is downwardly open so as to trap a body of air for flotation.

In accordance with this invention, the height to which the ball type float valve V1 can be lifted is restricted by height limiting means H1, restricting the height of said valve with respect to the valve seat 10 from which it is lifted to cause flushing of the toilet. The restricted height is sufficient to permit the downward rush of water into and through the flush passage 12, but insufficient for the air chamber 24 to float the valve V1 away from the seat 10. Simultaneously during a flushing operation, the rush of flushing water inherently drags the float valve V1 toward the seat 10, so that an opened position thereof must be manually held through operation of the lever 19, and so that a closed position thereof is regained by simply releasing the lever 19. It is the dynamic flow of rushing flush water that provides a servo function shutting the ball valve V1, and precludes it from remaining open.

Figure 3:
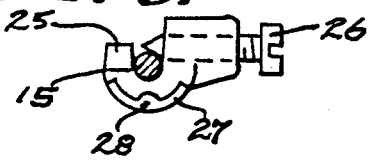
FIG. 3 is a view taken as indicated by line 3—3 on FIG. 2.
Figure 15:
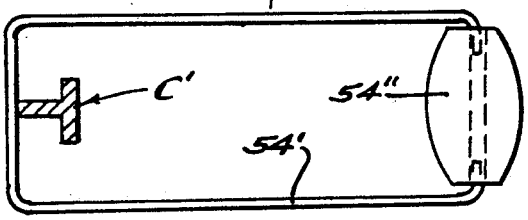
FIG. 15 is an enlarged detailed view taken as indicated by line 15—15 on FIG. 12.
Figure 4:
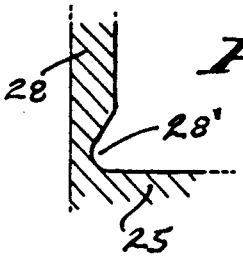
FIG. 4 is an enlarged fragmentary view taken as indicated by line 4—4 on FIG. 2.

The height limiting means H1 is a stop that restricts lifting of the ball type float valve V1, and in its preferred form is a stop clamp 25 secured to the lift rod 15 as by means of a set screw 26. As is clearly shown, the stop clamp 25 is positioned on the rod 15 to engage the guide bracket 17 when the aforementioned height limitation is reached, whereby flotation of the float valve is precluded when flushing occurs. A feature of this invention is the predetermination of the approximate height restriction, as shown in FIGS. 3-4, wherein a breakaway gage member 27 is made integral with the stop clamp 25, and which establishes dimension a as the limit of lifting motion for the rod 15 and valve V1 attached thereto. As shown in FIG. 3, the stop clamp 25 is hook-shaped to facilitate installation over the lift rod 15 without its removal. And as shown in FIG. 4 the gage member 27 is attached to the stop clamp 25 by a slender stem 28 weakened at 28' so as to be frangible and expendible after use in positioning the clamp 25.

The flapper type float valve V2 is shown in FIG. 5, comprised of a large diameter body 29 of rubber or the like having a downwardly faced planar sealing face 30 to engage on the upwardly faced valve seat 10. The lift chain 16 is coupled into the center of the valve body 29, through a loop or suitable connector 31 in a top wall 32 of the body 29, there being a depending peripheral wall 33 within the diameter of the valve seat 10. A characteristic feature of the valve V2 is that it is buoyant, and to this end the body 29 is formed by the walls 32 and 33 to establish a float chamber 34 by which the valve body 29 will float. In practice, the chamber 34 is downwardly open so as to trap a body of air for flotation.

In accordance with this invention, the height to which the flapper type float valve V2 can be lifted is restricted by height limiting means H2, restricting the height of said valve with respect to the seat 10 from which it is lifted to cause flushing of the toilet. The restricted height is sufficient to permit the downward rush of water into and through the flush passage 12, but insufficient for the air chamber 34 to float the valve V2 away from the seat 10. Simultaneously during a flushing operation, the rush of flushing water inherently drags the float valve V2 toward the seat 10, so that an opened position thereof must be manually held through operation of the lever 19, and so that a closed position thereof is regained by simply releasing the lever 19. It is the dynamic flow of rushing flush water that provides a servo function shutting the flapper valve V2, and precludes it from remaining open.

Figure 7:
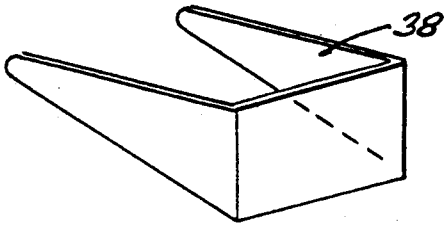
FIG. 7 shows the positioning template therefor.

The height limiting means H2 is a stop that restricts the lifting of the flapper type float valve V2, and in its preferred form is a forked stop bracket 35 secured to the overflow tube 18 as by means of a clamp 36 and screw 37. As is clearly shown, the stop bracket 35 is positioned on the tube 18 to engage the planar top wall 32 of the valve V2 when the aforementioned height limitation is reached, whereby flotation of the float valve V2 is precluded while flushing occurs. A feature of this invention is the predetermination of an approximate height restriction. As shown in FIG. 7 there is a template gage member 38 for insertion over the valve seat 10 and beneath the planar seal portion of the valve V2, for establishing a dimension a as the limit of lifting motion of the chain 16 and valve V2 lifted thereby. The planar top wall 32 is pivoted by means of a pair of integral arms that embrace the overflow tube 18 to rotate on transversely aligned trunions carried by the tube.

Figure 9:
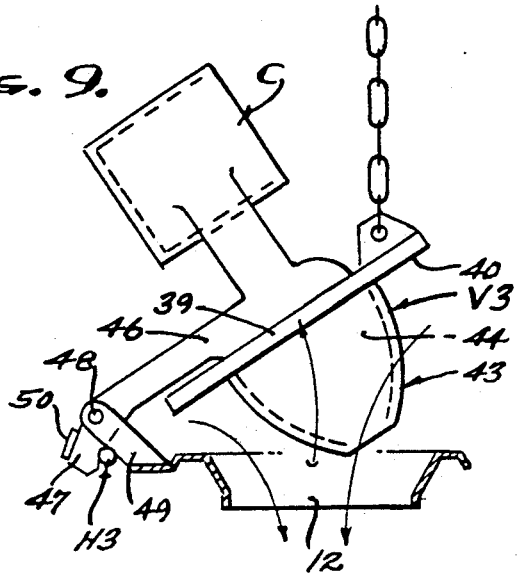
FIG. 9 is a view similar to FIG, 8, showing the limited open condition.
Figure 10:
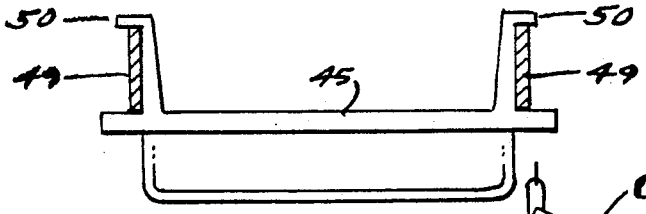
FIG. 10 is an enlarged view taken as indicated by line 10—10 on FIG. 8.

The tilt flapper type float valve V3 is shown in FIGS. 8 and 9, comprised of a large diameter body 39 of rubber or the like having a downwardly faced planar sealing face 40 to engage on the upwardly faced valve seat 10. The lift chain 16 is coupled onto the peripheral extremity of the valve body 39 by means of a suitable connector 41, there being a top wall 42 from which there is a depending peripheral wall 43 within the diameter of the valve seat 10. A characterisitic feature of the valve V3 is that it is buoyant, and to this end the body 39 is formed by the walls 42 and 43 to establish a float chamber 44 by which the valve body 39 will float. In practice, the chamber 44 is downwardly open so as to trap a body of air for flotation.

In accordance with this invention, the height to which the flapper body 39 can be lifted is restricted by height limiting means H3, restricting the height of said valve V3 with respect to the seat 10 from which it is lifted to cause flushing of the toilet. The restricted height is sufficient to permit the downward rush of water into and through the flush passage 12, but insufficient for the air chamber 44 to float the valve V3 away from the seat 10. Simultaneously during a flushing operation the rush of flushing water inherently drags the float valve V3 toward the seat 10, so that an opened position thereof must be manually held through operation of the lever 19, and so that a closed position thereof is regained simply by releasing the lever 19. It is the dynamic flow of rushing water that provides a servo function shutting the tilt flapper valve V3, and precludes it from remaining open.

There is a timing cup C which has no purpose in the operation of the height limiting means H3 disclosed herein as a stop that restricts tilting of the flapper type float valve V3. In its preferred form the height limiting means H3 is a spacer 45 secured to a stop lever that otherwise would stop at a substantially higher angular position of the flapper body 39 in order to ensure flotation. However, it is the primary object of this invention to preclude flotaton of valve V3 through the aforesaid servo function of rushing flush water, and to this end the stop spacer 45 limits tilting of valve V3 so as to ensure this effect. As shown, the valve body 39 is carried by a longer arm 46 of a first class lever, the shorter arm 47 extending oppositely from a pivot 48 to stop against the spaced legs 49 of a support extending upward from the seat 10 assembly.

In accordance with this invention, the height limiting means H3 is a stop spacer 45 in the form of a rod held disposed between the spaced arms 47 and complementary opposed spaced stop legs 49. In practice, hook means 50 secures the spacer rod 45 in position and restricts upward motion of the arm 46 limiting tilt of the valve V3.

Figure 12:
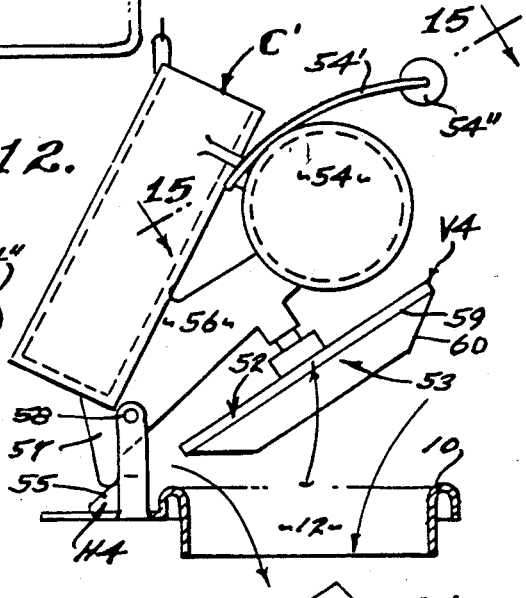
FIG. 12 is a view similar to FIG. 11, showing the limited open condition.

The tilt disc type float valve V4 is shown in FIGS. 11 and 12, comprised of a large diameter body 59 of rubber or the like having a downwardly faced conical sealing face 60 to engage on the upwardly faced seat 10. The disc body 59 has a top wall 52 depending from a longer arm 56 of a first class lever, the shorter arm 57 extending oppositely from a pivot 58 to engage a stop. A characteristic feature of the valve V4 is that it is bouyant, and to this end the arm 56 carries a sealed float chamber 54 by which the valve body 59 will float. In practice, the chamber 54 is extremely bouyant so as to ensure automatic toilet operation which is to be defeated by this invention. Therefore, ballast means B is provided to defeat bouyancy of float chamber 54, in the form of a U-shaped arm 54' that embraces a strut member of the float chamber and which extends to carry a ballast weight 54'' that sinks the chamber and attached valve V4.

In accordance with this invention, the height to which the flapper body 59 can be lifted is restricted by height limiting means H4, restricting the height of said valve V4 with respect to the seat 10 from which it is lifted to cause flushing of the toilet. The restricted height is sufficient to permit the downward rush of water into and through the flush passage 12, but insufficient for the air chamber 54, with the ballast weight 54'', to float the valve V4 away from the seat 10. Simultaneously during a flushing operation the rush of flushing water inherently drags the float valve V4 toward the seat 10, so that an opened position thereof must be manually held through operation of the lever 19, and so that a closed position thereof is regained simply by releasing the lever 19. It is the dynamic flow of rushing water that provides a servo function shutting the tilt flapper valve V4, and precludes it from remaining open.

There is a timing cup C' which has no purpose in the operation of the height limiting means H4 disclosed herein as a stop that restricts tilting of the disc type float valve V4. However, the lift chain 16 is coupled to the top of the timing cup C' as by means of a suitable connector 51. In its preferred form the height limiting means H4 is a spacer 55 secured to the stop lever 57 that otherwise would stop at a substantially higher angular position of the disc body 59 in order to ensure flotation. However, it is the primary object of this invention to preclude flotation of valve V4 through the aforesaid servo function of rushing flush water, and to this end the stop spacer 55 limits tilting of valve V4 so as to ensure this effect. As shown, the valve body 59 is carried by the longer arm 56 of the first class lever, the shorter arm 57 extending oppositely from the pivot 58 to engage against a stop of a support extending upward from the seat assembly.

Figure 13:
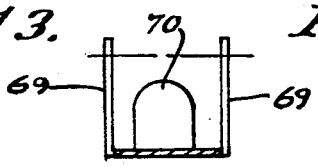
FIG. 13 is a sectional view of the supporting bracket taken by line 13—13 on FIG. 11.
Figure 14:
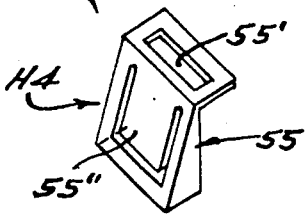
FIG. 14 is a perspective view of the limiting means.

In accordance with this invention, the height limiting means H4 is a stop spacer 55 in the form of a wedge held disposed between spaced support legs 69 for the pivot 58. The wedge is a sinkable metal bracket positioned as by means of a slot 55' (see FIG. 14) slidably engaged over a togue 70 (see FIG. 13) projecting between the legs 69. The metal spacer wedge 55 is provided with a bendable tab 55" that adjusts movement of the arm 57 and thereby restricts upward motion of the arm 56, thereby limiting tilt of the valve V4.

Having described only the typical preferred forms and applications of my invention, I do not wish to be limited or restricted to the specific details wherein set forth, but wish to reserve to myself any modifications or variations that may appear to those skilled in the art as set forth within the limits of the following claims.

I claim:

1. A toilet flush control for toilets having a flush tank with a valve seat normally closed by a buoyant ball type float valve held shut by a head of water pressure in the flush tank and carried by a lift rod extending upwardly through a guide, said lift rod being coupled to a manually operable lift means to raise the float valve for its buoyant separation from the valve seat and normal continued flushing of water through the toilet until the flush tank is emptied, said flush control being comprised of a height limiting means including a stop mounted on said lift rod for restricting lifting movement of the rod with respect to the guide during manual operation of said lift means and a removable gage means carried by the stop for determining the distance from said guide at which said stop should be secured to said lift rod in order to limit movement of the rod with respect to the guide so as to position the float valve a distance insufficient for its buoyant separation from the valve seat such that said float value will remain sufficiently close to the valve seat so that drag by means of the flushing water passing thereby will cause a servo function that closes the float valve onto the valve seat when the lift means is manually released.

2. The toilet flush control as set forth in claim 1, wherein the gage means is comprised of a frangible stem projecting a predetermined distance from the stop and positionably engaging the guide and weakened at the stop for its removal, whereby the gage means is expendable.

3. The toilet flush control as set forth in claim 1, wherein the stop is hook-shaped and placed laterally over the rod and secured thereto.

4. The toilet flush control as set forth in claim 1, wherein the stop is a hook-shaped clamp placed laterally over the rod and secured thereto by a set screw engaged therewith.

5. The toilet flush control as set forth in claim 1, wherein the gage means is comprised of a stem projecting a predetermined distance from the stop and positionably engaging the guide and weakened at the stop for its removal.

* * * * *